United States Patent [19]

Bonetti et al.

[11] Patent Number: 5,072,768

[45] Date of Patent: Dec. 17, 1991

[54] HINGE FOR FOLDING CLOSURE

[75] Inventors: Massimo Bonetti, Padua; Giuseppe Manente, Mestre; Abramo Mion, Mirano-Zianigo, all of Italy

[73] Assignee: Kairos S.N.C. Di M. Bonetti, A. Manente, E. A. Mion Ing. & Arch., Venice, Italy

[21] Appl. No.: 648,310

[22] Filed: Jan. 29, 1991

Related U.S. Application Data

[63] Continuation of Ser. No. 313,047, Feb. 21, 1989, abandoned.

[30] Foreign Application Priority Data

Feb. 19, 1988 [IT] Italy ..... 84104 A/88

[51] Int. Cl.[5] ..... E05D 15/26

[52] U.S. Cl. ..... 160/199; 160/213

[58] Field of Search ..... 160/199, 196.1, 206, 160/213, 118, 201; 49/127, 130, 125, 128, 129

[56] References Cited

U.S. PATENT DOCUMENTS

| | | | |
|---|---|---|---|
| 2,408,525 | 10/1946 | Miller et al. | 160/199 X |
| 3,341,985 | 9/1967 | Haws et al. | 49/127 X |
| 3,342,246 | 9/1967 | Reiss | 160/206 X |
| 3,394,496 | 7/1968 | Pulaski | 49/127 |
| 3,397,487 | 8/1968 | Hunt et al. | 49/130 |
| 3,494,407 | 2/1970 | Hollands et al. | 160/199 |
| 3,654,732 | 4/1972 | Schacht | 49/127 |

FOREIGN PATENT DOCUMENTS

| | | |
|---|---|---|
| 905284 | 7/1972 | Canada . |
| 1925314 | 5/1970 | Fed. Rep. of Germany . |
| 2322540 | 11/1973 | Fed. Rep. of Germany . |
| 2418193 | 10/1975 | Fed. Rep. of Germany . |
| 498961 | 1/1920 | France . |

*Primary Examiner*—David M. Purol

*Attorney, Agent, or Firm*—Hoffman, Wasson & Gitler

[57] ABSTRACT

A multi-panel, folding closure for a closet or recess has one panel supported on an upright by a mechanism which permits that panel to move horizontally with respect to the upright for practically its entire width, thus permitting the closure to be stowed entirely within the recess when the closure is open.

24 Claims, 5 Drawing Sheets

52
53
50
51
118

44
132
136
102
47
107
37
54
133
101
116
135
134
46

HINGE FOR FOLDING CLOSURE

This is a continuation of copending application Ser. No. 07/313,047 filed on Feb. 21, 1989 now abandoned.

BACKGROUND OF THE INVENTION

This invention relates to a closure device with hinged panels.

Closure devices for recesses and spaces are known for the purpose of delimiting volumetric expanses in general.

In DE-A-2,045,763 a closure device is described for a recess, comprising a system of door panels which undergo a mixed sliding and rotary movement in passing from a configuration in which the recess is open, in which they lie to the side of the lateral walls of this latter and allow access to its interior, to a configuration in which the recess is closed, in which they lie coplanar to close the recess at its front.

More specifically, this mixed movement of the panels requires for each of them the use of a device comprising an upright which can move parallel to the lateral wall of the recess and has its end guided for the purpose of this movement along two guides provided in the recess floor and ceiling. This upright is also guided in its transverse traversing movement by a pantograph arrangement of hinged rods disposed parallel to the lateral wall of the recess, its movement being facilitated by springs connecting at least one rod to a fixed point of the recess. The panel which closes the recess is hinged to the upright by conventional hinges. The operation to obtain complete closure therefore requires the lateral sliding of the upright parallel to the lateral wall of the recess, i.e. the outward withdrawal of the panel disposed adhering to this lateral wall, followed by a 90° rotation of the panel so that it becomes positioned in the plane of the recess aperture. To open the recess the same operations are performed in the reverse sequence.

A drawback of this known closure system is that the assembly comprising the upright, the hinged rods and the means for connection to the recess walls has a certain bulk which reduces the useful depth of the recess available to receive the panel when open. If the panel is to be totally concealed when in the open configuration, its width must be less than the depth of the recess, this obviously representing a considerable limitation which governs the width of the recess, especially if of small depth.

For small-depth recesses of greater width it has also been proposed to use several side-by-side closure devices, but this multiplies the drawbacks which each of them possesses.

A further drawback is that the hinged-rod pantograph system places limits on the panel length and means that in the case of panels of a certain height a number of pairs of rods must be used distributed along this height, with obvious increase in the constructional complexity of the assembly, its construction cost and the difficulty of installing and adjusting each panel.

A further drawback is that in order to prevent dangerous and undesirable lateral bending (waviness) of the hinged-rod pantograph system during the panel movement, the upright connected to these rods and to which the panel is hinged must be guided along guides which have to be installed in the floor and ceiling, and are visible from the outside, this being particularly so in the case of the guide in the floor.

A further drawback is that the pantograph mechanism is visible from the outside and can also catch against objects placed in the recess, in particular articles of clothing. It is possible to avoid this by covering the pantograph mechanism with a cover panel (side panel) which however substantially reduces the useful opening of the recess.

SUMMARY OF THE INVENTION

An object of the invention is to obviate all these drawbacks by providing a closure device with hinged panels which is simple to install and set up, does not require substantial alteration to the recess floor and ceiling, and does not require pantograph mechanism, with all the limits which these imply.

A further object of the invention is to provide a closure device with hinged panels which allows total containment of the panel even in the case of very wide recesses of small depth.

A further object of the invention is to provide a device which can be used not only for closing recesses but also for forming cupboards and delimiting volumetric expanses not of recess form, and in particular for creating temporary room divisions.

All these and further objects which will be apparent from the description given hereinafter are attained according to the invention by a closure device with hinged panels of the type in which the panels undergo mixed sliding and rotary movement, characterised by comprising:

an upright to be fixed in proximity to the plane in which the panels lie when in the configuration which closes a space, at least one pair of panels hinged together to pass from a non-folded state, in which they are disposed substantially in the plane of closure of said space, to a folded state in which they are disposed orthogonally to said closure plane and face each at a distance apart sufficient to receive said upright between them, and means for connecting one of said panels to said upright, said means comprising a member which enables said panel to undergo horizontal guided sliding in contact with said upright substantially from one vertical edge to the other.

BRIEF DESCRIPTION OF THE DRAWINGS

Two preferred embodiments of the present invention are described in detail hereinafter with reference to the accompanying drawings in which.

DESCRIPTION OF THE PREFERRED EMBODIMENTS

Figure 1:
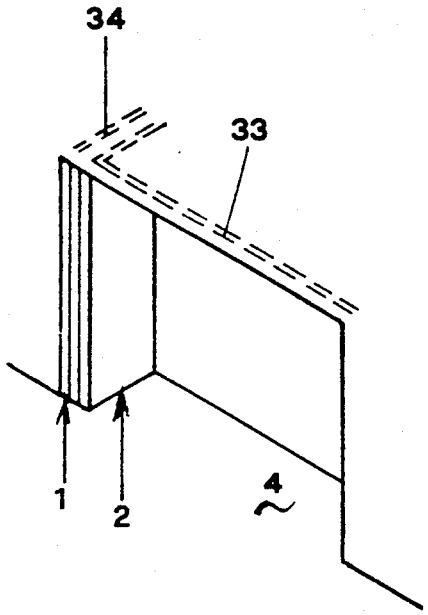
FIGS. 1 to 4 show four successive stages in the opening of the device according to the invention applied to a recess.

As can be seen from the figures, the embodiment of the device according to the invention shown in FIGS. 1-5 comprises substantially a pair of panels 1, 2 hinged together along a vertical edge, and an upright 3 to be fixed in a suitable position in correspondence for example with the space 4 to be closed. One of the two panels 1 is secured to the upright 3 in such a manner as to be able to slide horizontally with respect to it substantially from one vertical edge to the other.

More specifically, the two panels 1, 2, which are of equal dimensions, are of L cross-section comprising a major surface 5 which forms the front closure surface, and a minor surface 6 which forms an element for spacing it from the other panel 2 when the two panels are side-by-side in their folded configuration, and is provided with a hinge 7 for its hinging to the corresponding minor surface 6 of the other panel 2.

The upright 3 consists of a tubular element 8 (FIG. 5) supported by a pair of brackets 9 and 10 which are pivoted on two pivots 11, 12 fixed to the ceiling 13 and to the floor 14 of the recess 4.

Said pivots 11, 12 can be secured respectively to the ceiling 13 and floor 14 of recess 4 by any suitable means, for example by providing said pivots 11, 12 on mounting plates to be fixed to the corresponding parts by screws.

Preferably each bracket 9, 10 comprises a tubular head into which one end of the tubular element 8 is inserted, and an appendix for its rotatable connection to the corresponding pivot 11, 12. The appendix of the upper bracket 9 is of L-shape, whereas the appendix of the lower bracket is of C-shape to enable it to support the rotation shaft 15 of a guide and support roller 16, as described hereinafter.

Within the tubular element 8 of the upright 3 and coaxial thereto there is provided a further tubular element 17. This is supported between the two heads of the brackets 9, 10 by corresponding support bearing 18, 19 respectively, and extends beyond said heads to provide two gear wheels 20, 21 and beyond these to provide two guide bearings 22, 23.

Two profiled guide bars 24, 25 are applied to the panel 1 by conventional systems.

The upper profiled bar 24 comprises a rack 26 positioned at the height of the gear wheel 20 of the upright 3, and an L-shaped flange 27, against the downwardly extending inner vertical wall of which the upper bearing 22 rides to keep said gear wheel 20 engaged with said rack 26.

Correspondingly, the lower profiled bar 25 comprises a rack 28 positioned at the height of the gear wheel 21 of the upright 3, and an L-shaped flange 29, to the upwardly extending inner vertical wall of which there adheres the lower bearing 23 to keep said gear wheel 21 engaged with said rack 28.

In addition a vertical rib 30 extends from the flange 29 of the profiled bar 25 to engage in a corresponding circumferential groove 31 in the underlying roller 16.

A guide roller 32 is applied to the upper edge of the panel 2, for example by a plate provided with screws, and engages in a guide rail 33 provided in the ceiling 13 of the recess 4. The rail 33 is of U cross-section and of L-shape, with its longer portion parallel to the closure surface of the recess 4 and its shorter portion orthogonal to this latter and disposed in proximity to the upright 3.

A further guide rail 34 parallel to the shorter portion of the rail 33 can be advantageously provided for a roller 35 applied to the panel 1, at the other side of the upright 3.

The device according to the invention is installed simply by fixing the two pivots 11, 12, while already engaged in the brackets 9, 10 of the upright 3, to the ceiling 13 and to the floor 14 of the recess 4.

The profiled bars 24, 25 are not fixed directly to the panel 1 but instead are slidable axially on profiled bars 24', 25' fixed to said panel, to allow the alignment of the panels to be adjusted if this is required because of inaccuracies in assembly. A set screw 49 is then used to lock each profiled bar 24, 25 onto the corresponding bar 24', 25'.

When installation is complete the closure device is ready to operate. When the recess is open (see FIG. 1) the two panels 1 and 2 are positioned parallel to and facing each other and are kept at a distance apart greater than the overall transverse dimension of the upright 3 because of the presence of the minor surfaces 6, which are hinged together. In this configuration the panel 1 is practically stabilized in position by the engagement of the roller 35 in the rail 34 and the panel 2 is likewise stabilized in position by the engagement of the roller 32 in that portion of the rail 33 parallel to the lateral wall of the recess. If the recess depth is equal to or greater than the width of each of the two panels 1, 2 (this being the normal case), in the currently described configuration the two now folded panels are completely housed within the recess 4 to form a sort of "side panel" for it.

To close the recess, the two panels 1, 2 are firstly withdrawn together to the outside of the recess, this being made simple by the engagement between the two profiled bars 24, 25 and the corresponding parts of the upright 3. In this respect, the two panels are together supported by the profiled bar 25 which rests with the longitudinal rib 30 of its L-shaped flange 29 in the roller 31. The two panels are also together kept adhering to the upright 3 by the engagement between the two bearings 22, 23 and the flanges 27, 29 of the corresponding profiled bars 24, 25, and are guided to undergo smooth regular movement by the engagement between the two gear wheels 20, 21 which rotate rigid with each other by virtue of the inner tubular element 17, and the racks 26, 28 of the corresponding profiled bars 24, 25.

Figure 2:
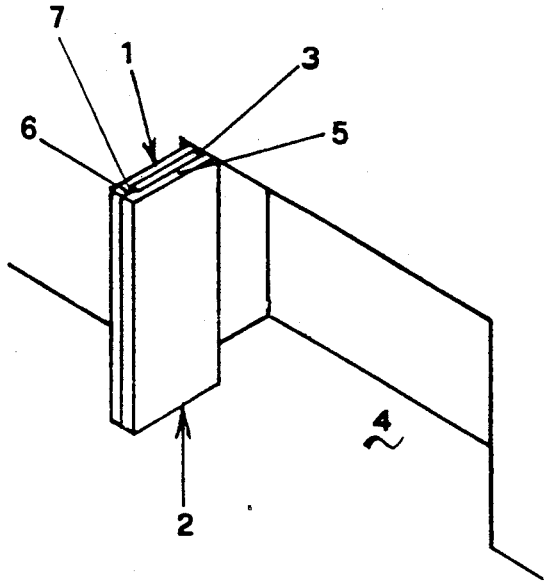

On completion of this withdrawal movement, which can be considered purely translational because of the constant engagement of the guide rollers 32, 35 in the corresponding portion of the guide rails 33, 34, the two panels 1, 2 together assume the configuration of maximum projection from the recess 4 (see FIG. 2).

Figure 3:
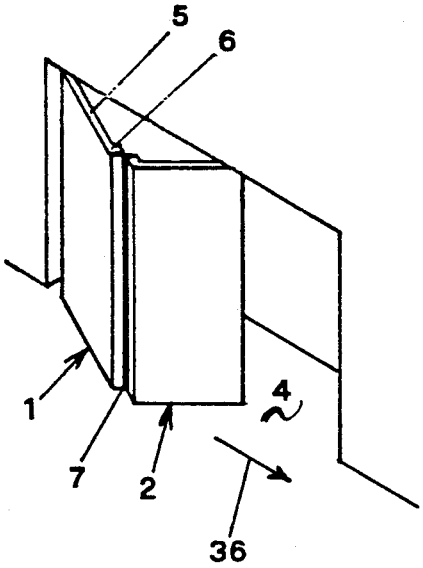
Figure 4:
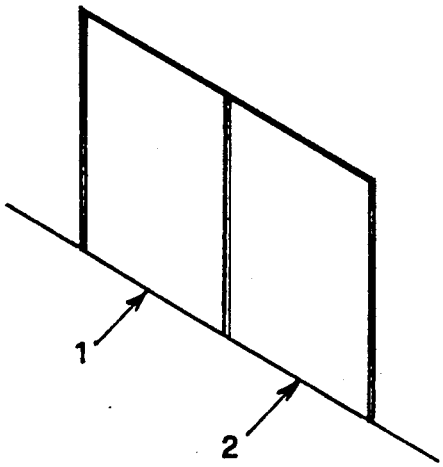
Figure 5:
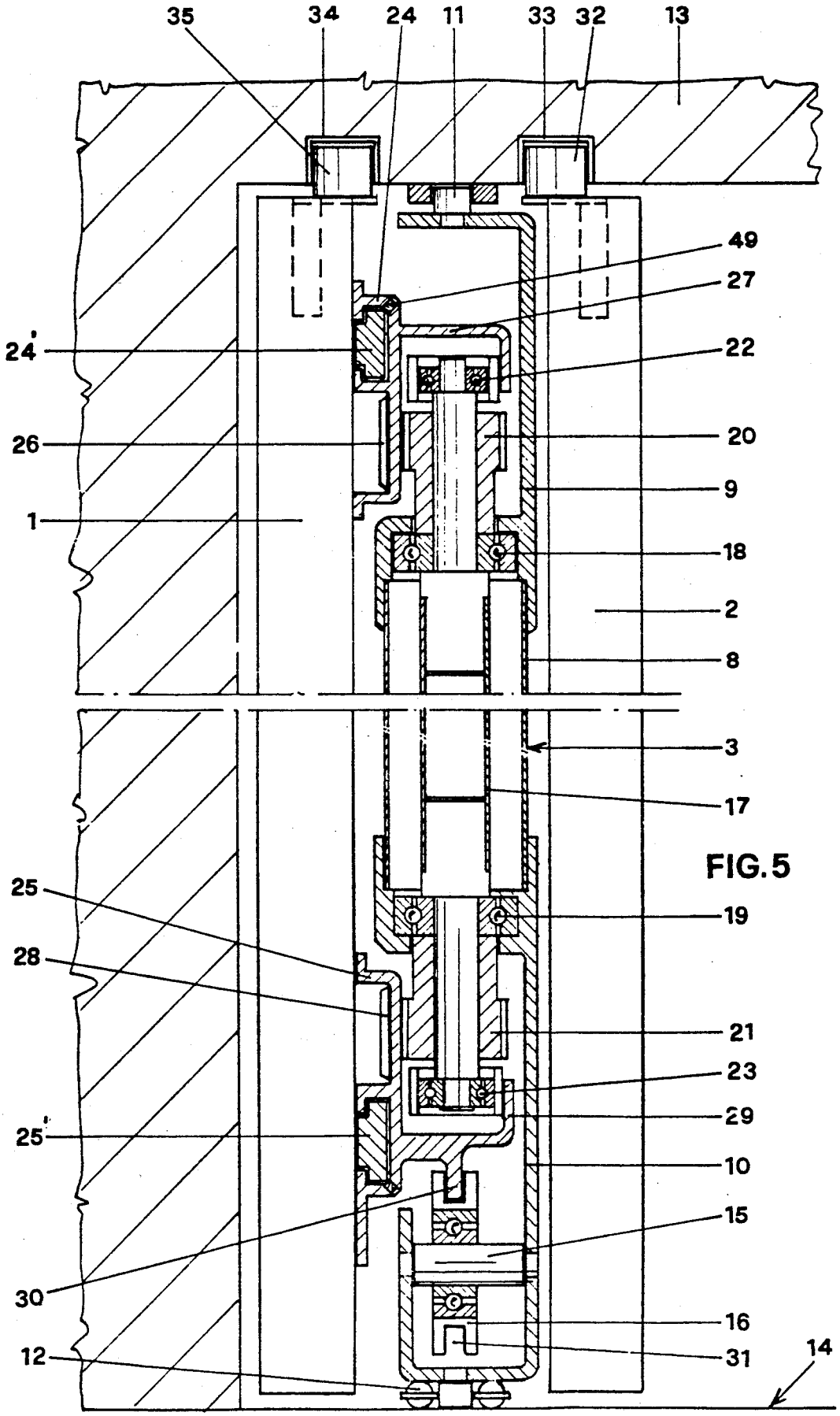
FIG. 5 is an enlarged vertical section through a first embodiment thereof in the configuration shown in FIG. 1.
Figure 6:
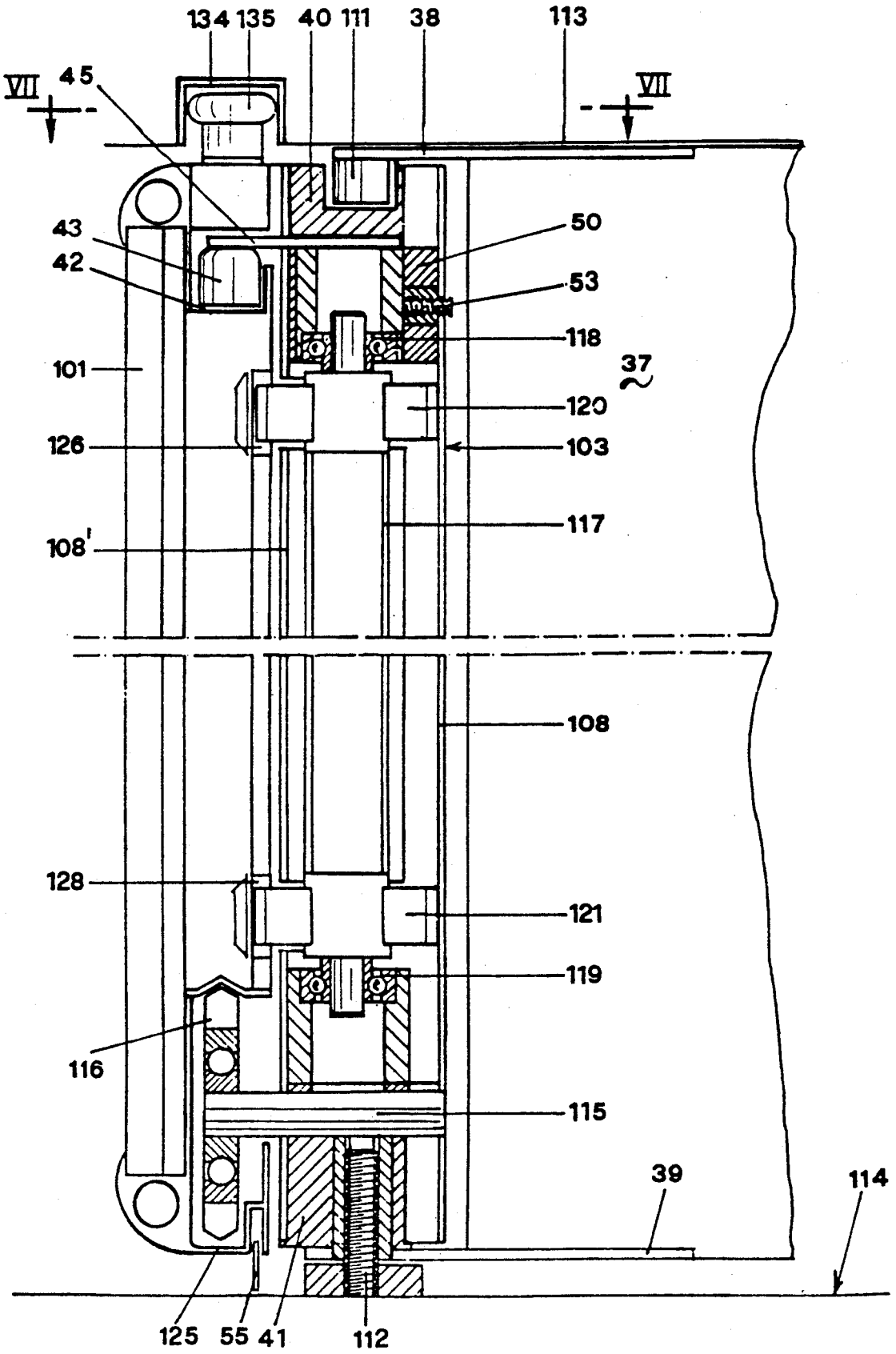
FIG. 6 is a vertical section orthogonal to that of FIG. 5 through a second embodiment thereof.

At this point it is necessary only to exert a light pull on the outer vertical edge of the panel 2 in the direction parallel to the front aperture of the recess 4, i.e., in the direction indicated by the arrow 36 in FIG. 3, to cause the two panels 1, 2 to simultaneously rotate in opposite directions until they become positioned parallel to each other to close the recess 4.

The reopen the recess 4, the aforesaid operations are carried out in reverse succession.

From the aforegoing it is apparent that the closure device according to the invention is more advantageous than conventional devices, and in particular:

it is assembled by merely fixing the ends of the upright 3 to the ceiling 13 and floor 14 of the recess 4, it covers a closure area which can have a width twice the depth of the recess, even when the panels housed within the same recess in folded configuration, it does not require drive members of the hinged rod type, which are of uncertain operation, are unattractively visible from the outside, and can catch against the articles in the recess, when in its folded configuration it occupies an overall space little greater than the overall size of the panels, it requires no alteration to be made to the floor of the recess, but merely the simple fitting of a guide into its ceiling, and which is practically invisible from the outside, it is simple and comfortable to operate, it can be applied in the form of several uniformly spaced units to the same recess, and with practically no limit to the dimensions of this latter.

FIGS. 6 to 13 illustrate a different embodiment of the device according to the invention, which can be applied preferably to the front edge of a panel 37 forming the side wall or dividing wall of the space to be closed. In these figures the elements corresponding to those of the first embodiment are indicated by the same reference numerals increased by 100.

In this embodiment, two preferably metal flanges 38, 39 are cantilever-fitted to the panel 37 to project from its horizontal front edges and carry two pivots 111, 112 for a vertical upright indicated overall by 103; the upper pivot 111 engages in a corresponding cylindrical seat in an end plug 40 of said upright 103, whereas the lower pivot consists in reality of a plug 41 internally threaded to receive the threaded portion of the actual pivot 112, by which the upright assembly to be vertically adjusted relative to the floor.

The upright 103 comprises an essentially cylindrical tubular element 108 delimited vertically by a flat wall 108'. Within and coaxially to the tubular element 108 there is disposed a further tubular element 117 rigidly connected to a pair of gear wheels tubular 120, 121 which partly emerge from the flat wall 108' of the outer tubular element 108 through a pair of apertures provided therein.

With the upright 103 there is associated a pair of panels 101, 102, similar to those of the preceding embodiment and hinged together preferably by a continuous hinge 107. One of said panels, 101, comprises along its upper edge a longitudinal guide groove 42 in which there engage a pair of rollers 43 applied to a plate 45 rigid with the upper plug 40 of the upright 103.

To said panel 101 there are applied two horizontal racks 126, 128 in which there engage those portions of the two gear wheels 120, 121 which emerge from the flat wall 108' of the tubular element 108.

A substantially C-shaped horizontal guide rail 125 is applied to the lower edge of the panel 101, to be engaged by a roller 116 of horizontal axis supported on its shaft 115 which is rigid with the lower plug 41 of the upright 103.

The upper flange of the C-shaped rail guide 125 is not plane, but has an upside down V section to follow the profile of the corresponding guide roller 116, to enable with the weight of the panel its centering with respect to said roller.

In the manner of the corresponding panel 2 of the first embodiment, the panel 102 is provided with a roller 132 applied in proximity to its upper edge and engaging in a corresponding L-shaped guide 133 applied to the ceiling 113 of the recess 104. At its end distant from the upright 103, this guide is provided with a block 144 for the stop of said roller 132 when the two panels 101,102 are in a coplanar condition.

In the guide rail portion 134 close to the upright 103 a spring 46 is provided formed by a steel shaped thin sheet.

The operation of this second embodiment of the device according to the invention is as follows: when the space is open the two panels 101,102 are positioned parallel to each other on one and the other side of the upright 103 and panel 37, to which said upright 103 is applied. In this configuration the flat surface 108' of the upright 108 is parallel to the surface of the panel 37.

Figures 7, 13:
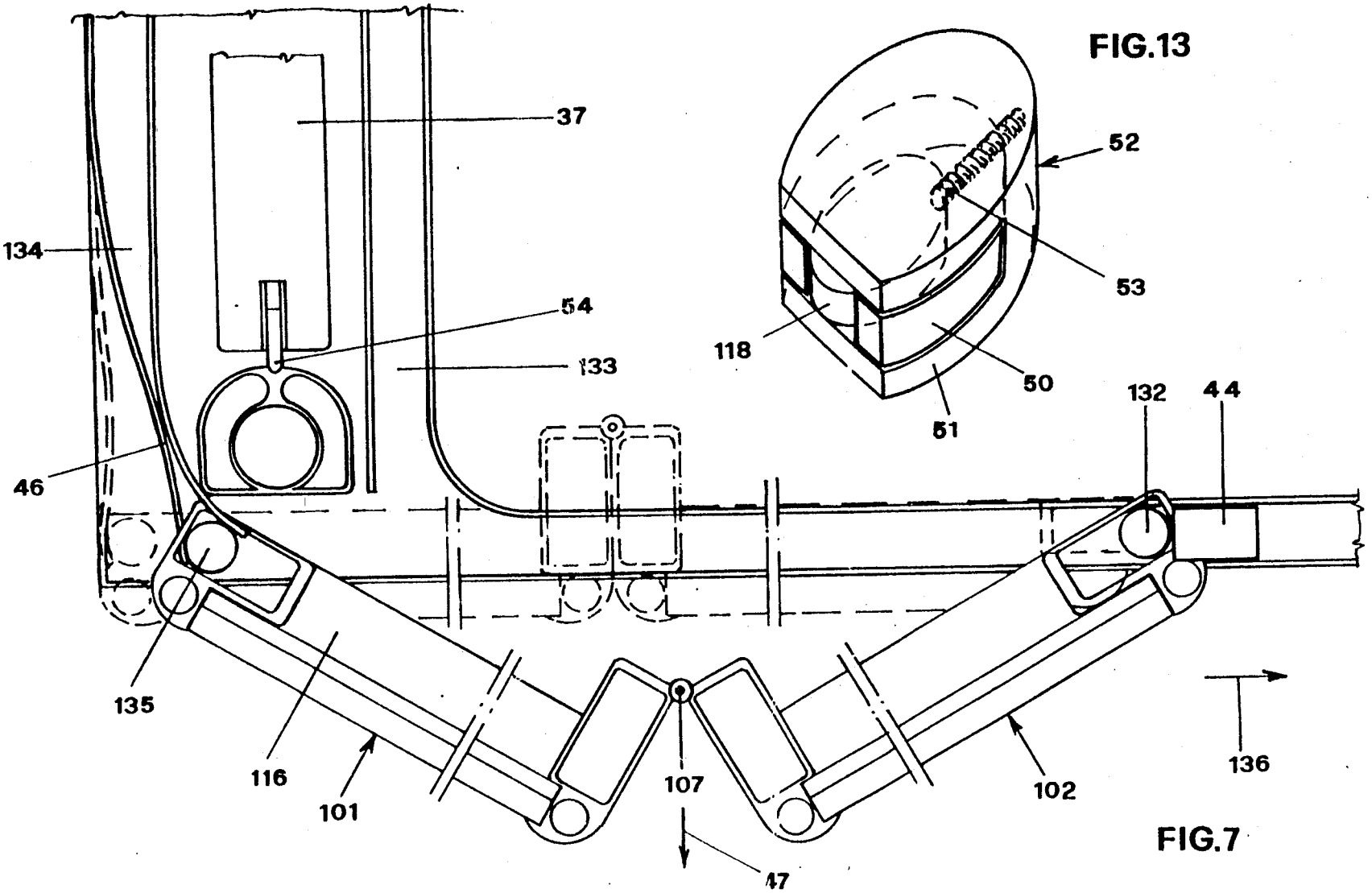
FIG. 7 is horizontal section therethrough on the line VII—VII of FIG. 6.
FIG. 13 is an enlarged detail, in perspective, of a portion of the upper end of the upright in this second embodiment.
Figure 8:
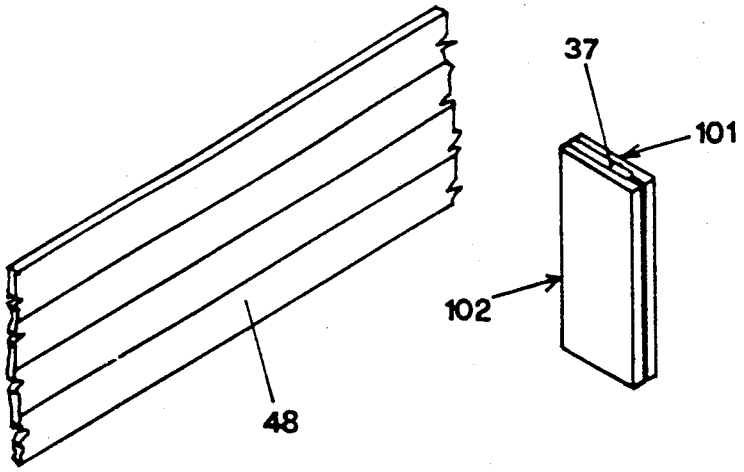
FIGS. 8 to 12 are diagrammatic representation of five successive stages in the delimitation of a space using the device of FIG. 6.
Figure 9:
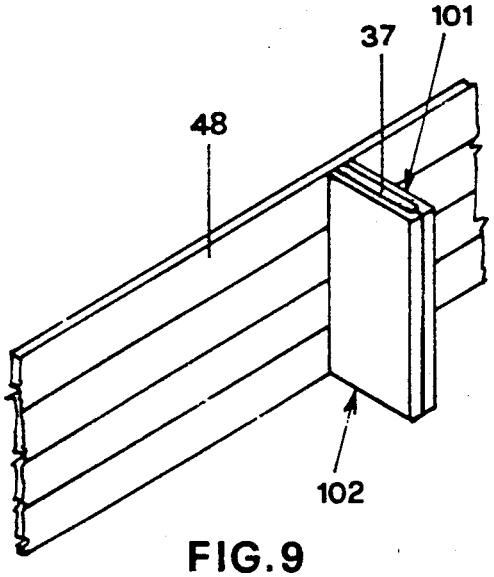
Figure 10:
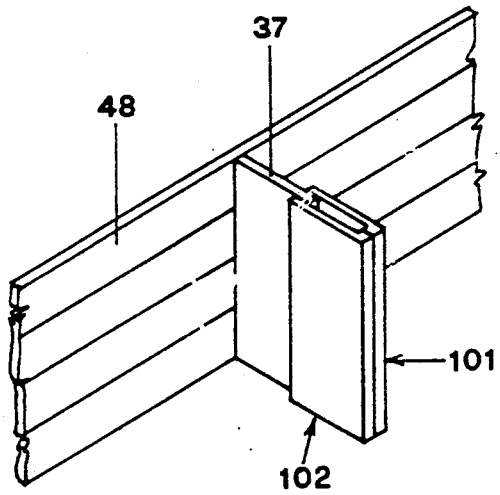
Figure 11:
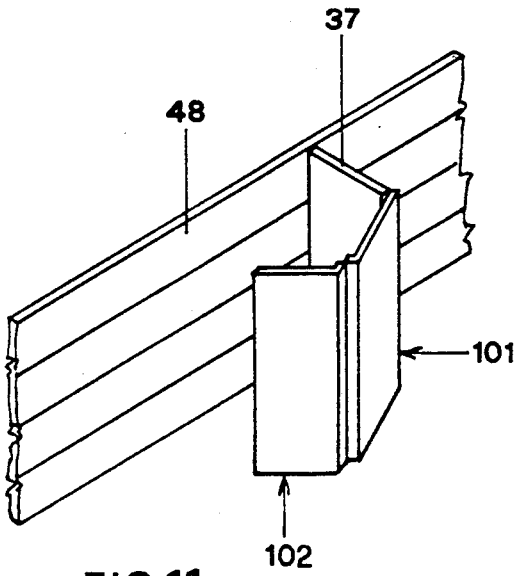
Figure 12:
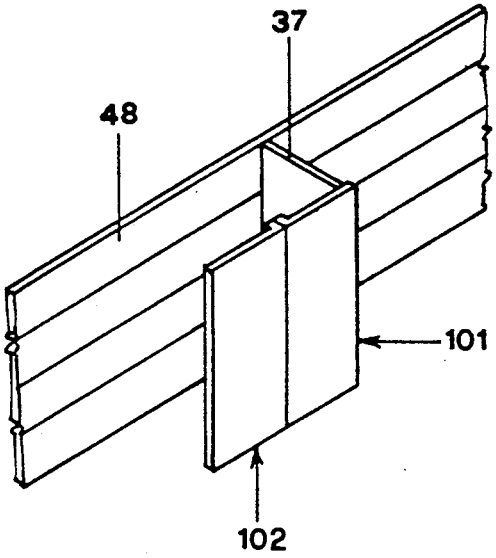

To close the space 104, the two panels 101,102 are together withdrawn outwards in the direction of the arrow 47 of FIG. 7. During this operation the two panels 101,102 undergo purely translational motion, ensured by the constraint between the panel 101 and upright 103 due to the engagement between the gear wheels 120,121 and racks 126,128, and also by the constraint between the roller 132 mounted on the panel 102 and the L-shaped guide applied to the ceiling 113 of the space 104, and between the rollers 43 applied to the upright 103 and the guide groove 42 provided in the panel 101.

Again in this case the panel 101 is provided with a roller 135 engaging in the rail 134 of the space 104, parallel to the corresponding minor portion of the L-shaped guide 133.

Shortly before the panels 101,102 reach the end of this translational movement, the roller 135 interferes with the spring 46 causing it to slightly yield, thus engaging a subsidence provided in it to ensure in such a way a certain stability of the panel 101 when in its end-of-travel position thus reached.

On termination of this translational movement it is sufficient to carry out a light traction on the vertical free edge of the panel 102 in the direction indicated by the arrow 136 in FIG. 7, to cause the diverging of the two panels with corresponding rotation of the upright 103 about its pivots 111,112 because of the engagement of the rollers 43 in the groove 42 provided in the panel 101. During this stage the engagement between the roller 135 and the subsidence of the elastic thin sheet has the purpose, as stated, to prevent translational rearward sliding of the panel 101.

This unfolding of the panels can continue until the roller 132 rests against to the block 44 and the panels have almost reached their coplanar condition. At this moment a slight pressure is carried out on the two panels near their articulation hinge 107, in such a way they arrange exactly coplanar, overcoming the elastic reaction of the spring 46 and loading it.

The attainment of the coplanar condition of the two panels causes a light sliding of the panel 101 in a direction which causes the entire closure of the portion of the recess 104 which it occupied in folded condition, that is the portion of the recess included between the panel 37 and the side wall of the same recess (see the dashed line in FIG. 7). Due to the position of the hinge 107 outside the plane extending along the axis of the roller 135 and 134, the spring 46 ensures the steadiness of the coplanar configuration of the two panels 101,102.

To open the space 104 said operations are carried out in the reverse order, i.e. the two panels are firstly pulled at their hinge 107 in the direction indicated by the arrow 47 of FIG. 7. This pull firstly causes the development of the elastic reaction of the spring 46 previously under pressure stressed and the subsequent disengagement of the roller 132 from the block 44. Then, when continuing this pull, the roller 132 slide along the guide 133 until the two panels are entirely folded and can be inserted into the space 104, to straddle the upright 103 and panel 37.

In order to limit the overall bulk of the panels when in their folded condition, it is preferable for the axis of rotation of the upright 103 to be closer to the panel 37 than the axis of rotation of the inner tubular element 117, and consequently of the gear wheels 120,121.

This second embodiment can be advantageously used in all those cases in which in addition to frontally closing a space it is also required to close it laterally. In this case the two panels 101,102 and the interposed panel 37 to which the upright 103 is fixed form together a unit which can be applied by any conventional system for example to a wall 48 (see FIGS. 8–12). If the fixing system is of removable type, its removal will leave the wall 48 completely free (see FIG. 8). If however the fixing system is of permanent type, when the device is in its folded configuration its two panels 101,102 are folded together and will project orthogonally from the wall 48.

To close the space, the two panels 101,102 are firstly withdrawn together to the outside of the panel 37 and are then slid laterally until the two panels are positioned orthogonally to said panel, i.e. parallel to the wall 48 to which it is fixed.

In this case the panel 102 not connected to the upright 103, and possibly both panel 101,102, must be guided at the floor 114 unless the space 104 to be closed has a cover or extends as far as the room ceiling, in which case the L-shaped guide 133 and possibly the rail 134 can be applied to said cover or ceiling.

In order to simplify assembly operations of the upright 103, the element 117, to which the two gear wheels 120,121 are keyed (the wheels partly extending from two windows provided in the tubular element 108), is supported at its end by two bearings 118,119 which are each encircled by a deformable eccentric C-shaped body 50, placed between two disk-shaped elements 51 of a plug 52 (FIG. 13) housed in the tubular element 108. A screw 53, which can be operated from outside, transversely pushes the corresponding bearing 118,119, which in its turn causes the diverging of the side arms of the eccentric body 50, which preferably consists of nylon, to cause it to block in such a way the plug 52 with respect the tubular element 108.

This second embodiment is particularly advantageous because the outer tubular element 108 of the upright 103 extends without interruption practically from the ceiling 113 to the floor 114 of the space 104 and prevents dust access to the moving parts.

In addition dust access to the interior of the space 104 when the panels 101,102 are positioned coplanar in their closure configuration is prevented by a longitudinal brush 54 mounted along the front vertical edge of the panel 37 and elastically adhering to the upright 103, and by a pair of strips 55 mounted at the lower edge of the two panels 101,102 and grazing the floor 114 under gravity contact.

We claim:

1. In a hinged leaf closure comprising at least one panel which undergoes mixed sliding and rotary movement, supported by an upright situated in proximity to a plane in which the panel lies when in its closed configuration, and having a pair of spaced, horizontal racks affixed to one surface of the panel, said racks being engaged with respective coaxial, interconnected gear wheels, the improvement comprising means for directly connecting one of said panels to said upright, said connection means comprising a horizontal guided sliding member in contact with said upright thereby enabling said panel to undergo horizontal guided sliding in contact with said upright substantially from one vertical edge of said panel to the other.

2. The invention of claim 1, wherein the upright is provided with upper and lower pivot mountings, each connected to the ends of the upright.

3. The invention of claim 2, further including two bearings and two guide bars, wherein the pair of gear wheels are keyed to a common shaft which extends between and beyond said gear wheels to support said two bearings engaged in said guide bars applied to the panel, in order to keep said racks engaged with the gear wheels.

4. The invention of claim 3, further including a horizontal profiled bar applied to one of said panels, said horizontal profiled bar provided with a rib, and wherein said horizontal guided sliding member is a roller, said roller is provided with a circumferential groove which engages said rib provided on said horizontal profiled bar.

5. The invention of claim 4, further including a C-profiled bar affixed to one of said panels, said roller engaging said C-profiled bar.

6. The invention of claim 5, wherein said C-profile bar is provided with an upper flange and said roller is provided with a lateral surface, and further wherein said upper flange of said C-profiled bar and said lateral surface of said roller have relative positions during the sliding of panel.

7. The invention of claim 2, wherein said lower pivot mounting of the upright includes screw means for adjusting the vertical position of said upright.

8. The invention of claim 3, wherein the upright comprises an outer tubular shaft housing in its interior said gear wheels, portions of which emerge from the housing to engage in the racks.

9. The invention of claim 8, wherein the axis about which said gear wheels rotate relative to the upright is different from the axis about which the upright rotates relative to its supports, and is closure to said panel.

10. The invention of claim 8, further including support bearings and plugs provided with an expansion element operable from the outside, wherein said support bearings supports said tubular shaft with respect to the tubular element of the upright, said support bearings supported by said plugs.

11. The invention of claim 1, further comprising at least one roller, and wherein at least one of said panels is provided with a horizontal groove, and further wherein said at least one roller mounted on a vertical axis and projecting from the upright to engage in said horizontal groove provided in said panel.

12. The invention of claim 1, wherein each of said panels is provided with upper and lower horizontal edges and wherein at least one of the lower and upper horizontal edges of each panel is provided with a strip which grazes the floor and/or ceiling of a space respectively, to prevent dust access to the interior when said panels are in there closure configuration.

13. The invention of claim 1, wherein the position of the horizontal racks is adjustable axially relative to the corresponding panel.

14. A closure having plural panels which undergoes mixed sliding and rotary movement, said closure provided between a top horizontal surface and a bottom horizontal surface, said closure moving between a retracted position to an extended position, comprising:

an upright affixed to one of the horizontal surfaces for supporting said panels;

at least one pair of panels interconnected by a hinge, and movable from a non-folded configuration, in which said panels lie substantially in a common plane, to a folded configuration, in which said panels are disposed orthogonally to said plane and face each other astride said upright; and means for connecting one of said panels to said upright, said connection means comprising a horizontal guided sliding member in contact with said upright, thereby enabling said panel to undergo horizontal guided sliding in contact with said upright substantially from one vertical edge of said panel to the other.

15. The invention of claim 14, wherein each panel is substantially of L-shape in plan view, with a major portion forming the actual closure surface, and a minor portion which is hinged to the minor portion of the other panel to keep the two major portions spaced apart when in the folded condition.

16. The invention of claim 14, where the two leaves are hinged together along the edge of the minor portion by a continuous shape.

17. The invention of claim 14, wherein the top horizontal surface is provided with a guide rail therein, and the panel not directly secured to said upright is provided with a first roller for its guiding within said guide rail.

18. The invention of claim 17, wherein said guide rail is configured in an essentially L-shape with a longer portion disposed along the closure surface of the space and with the shorter side disposed orthogonally thereto in proximity to said upright.

19. The invention of claim 13, further including a blocking element provided in said guide rail for opposing the movement of said first roller when the two panels are in the unfolded condition.

20. The invention of claim 18, wherein the leaf is provided with a second roller for guiding it in the shorter portion of said L-shaped guide rail.

21. The invention of claim 20, further comprising elastically yieldable means to stabilize the position of the leaf when in the configuration corresponding to the extended position of the panels.

22. The invention of claim 20, wherein said elastically yieldable means comprises a metal sheet spring housed within said guide rail and acting on said second roller.

23. The invention of claim 22 wherein, when the panels are in the closed condition, said spring is stressed by the roller.

24. The invention of claim 14, wherein each of said panels is provided with upper and lower horizontal edges, and wherein at least one of the upper and lower horizontal edges of each panel is provided with a strip which grazes the floor and/or ceiling of a space respectively, to prevent dust access to the interior when said panels are in their closure configuration.

* * * * *